United States Patent [19]

Donaldson

[11] 4,002,201

[45] Jan. 11, 1977

[54] MULTIPLE FLUID STACKED PLATE HEAT EXCHANGER

[75] Inventor: Desmond M. Donaldson, Halton, Canada

[73] Assignee: Borg-Warner Corporation, Chicago, Ill.

[22] Filed: May 24, 1974

[21] Appl. No.: 473,254

[52] U.S. Cl. ..... 165/140; 165/166; 165/167; 165/175

[51] Int. Cl.[2] ..... F28F 3/08

[58] Field of Search ..... 165/130, 166, 140, 175, 165/167, 153

[56] References Cited

UNITED STATES PATENTS

| | | | |
|---|---|---|---|
| 2,591,878 | 4/1952 | Rogers et al. | 165/167 X |
| 2,610,835 | 9/1952 | Hytte | 165/166 X |
| 2,617,634 | 11/1952 | Jendrassik | 165/140 |
| 2,623,736 | 12/1952 | Hytte | 165/140 X |
| 2,872,165 | 2/1959 | Wennerberg | 165/166 X |
| 2,952,444 | 9/1960 | Jenssen | 165/166 X |
| 3,207,216 | 9/1965 | Donaldson | 165/130 X |
| 3,469,626 | 9/1969 | Wright et al. | 165/166 |
| 3,650,321 | 3/1972 | Kaltz | 165/130 X |
| 3,757,856 | 9/1973 | Kun | 165/166 |
| 3,850,234 | 11/1974 | Fowler | 165/166 X |
| 3,862,661 | 1/1975 | Kovalenko et al. | 165/166 |

*Primary Examiner*—Albert W. Davis, Jr.
*Assistant Examiner*—Sheldon Richter
*Attorney, Agent, or Firm*—James A. Geppert

[57] ABSTRACT

A heat exchanger of a stacked plate design wherein two or more fluids are in heat exchange relationship, comprising two or more independent sets of plates with the fluid passages of one set of plates being interconnected for continuous flow therethrough and the other set of plates being similarly interconnected and interleaved with the first set; and each of the plates in the two or more sets being separated by intermediate fins which serve as secondary heat exchange surfaces.

9 Claims, 9 Drawing Figures

MULTIPLE FLUID STACKED PLATE HEAT EXCHANGER

BACKGROUND AND SUMMARY OF THE INVENTION

Stacked plate heat exchangers have heretofore been designed to provide heat transfer from one fluid to another through contacting plates. These heat exchangers utilize a plurality of relatively thin heat conducting or transfer plates which are assembled in spaced face to face relation in such a manner as to provide a multiplicity of shallow fluid flow spaces or chambers; which are separated from one another by plates and are interconnected by circulating passages or connections in such a way that fluids or fluid streams of different temperatures can be circulated through flow spaces on opposite sides of and in contact with each heat transfer plate for the exchange of temperature from one fluid or stream to the other.

One heat exchanger design includes a series of interconnected plates, containing a fluid to be cooled, which are separated by spacers or fin structures to allow for air circulation between the plates; the circulating air acting as a cooling medium for the fluid circulating through the stacked plates. Other designs utilize plates that are normally placed in spaced parallel relationship with spacers therebetween and the coolant fluid flows through one set of plates and alternate plates have fluid to be cooled flowing therethrough. These designs all rely upon intimate contact of the plates for effective heat transfer from a plate carrying one fluid to a plate or spacer for a second fluid. Plates carrying buffer fluid between the coolant and the fluid to be cooled have also been utilized. Normally a complicated assembly is entailed with difficult manufacture.

Among the objects of the present invention is the provision of a stacked plate heat exchanger assembly wherein the plates are of a common unique design, such that a first set of plates may be stacked in one position and the plates of a second set may be interleaved with the plates of the first set merely by reversing their position with respect to the first set; wherein the inlets and outlets of the first set may be located along a common edge of the stack and the second set has its inlets and outlets located along the opposite edge of the stack.

Another object of the present invention is the provision of a novel heat exchanger assembly wherein the first and second sets of stacked plates have a direct thermal connection with a common system of secondary heat exchange surfaces through which a fluid such as air is adapted to be passed. This invention comprehends a novel, compact heat exchanger which can be used in automobile air conditioning and heating systems and which performs the function of either a heater or an evaporator coil, that is for heating and cooling. The damper control normally required to selectively direct air either through the air core or the evaporator coil is no longer required for the present structure.

The present invention also comprehends the provision of a heat exchanger assembly in which common secondary surfaces in the form of fins are utilized to bridge the spaces between the two sets of interleaved plates and which serve either for cooling or heating.

A further object of the present invention is the provision of a heat exchanger assembly where, in addition to being alternately useable for heating or cooling by passing air through the fins and so arranging the fins to effect a heat transfer from one fluid to another, the coolant fluid in the heater section of the coil can be utilized to serve as a heat sink for the refrigerant of the air conditioning system; thus reducing the number of cycles required of the refrigerating system when working at a partial load.

Further objects are to provide a construction of maximum simplicity, efficiency, economy, and ease of assembly and operation, and such further objects, advantages and capabilities as will later more fully appear and are inherently possessed thereby.

DESCRIPTION OF THE PREFERRED EMBODIMENTS

Figure 1:
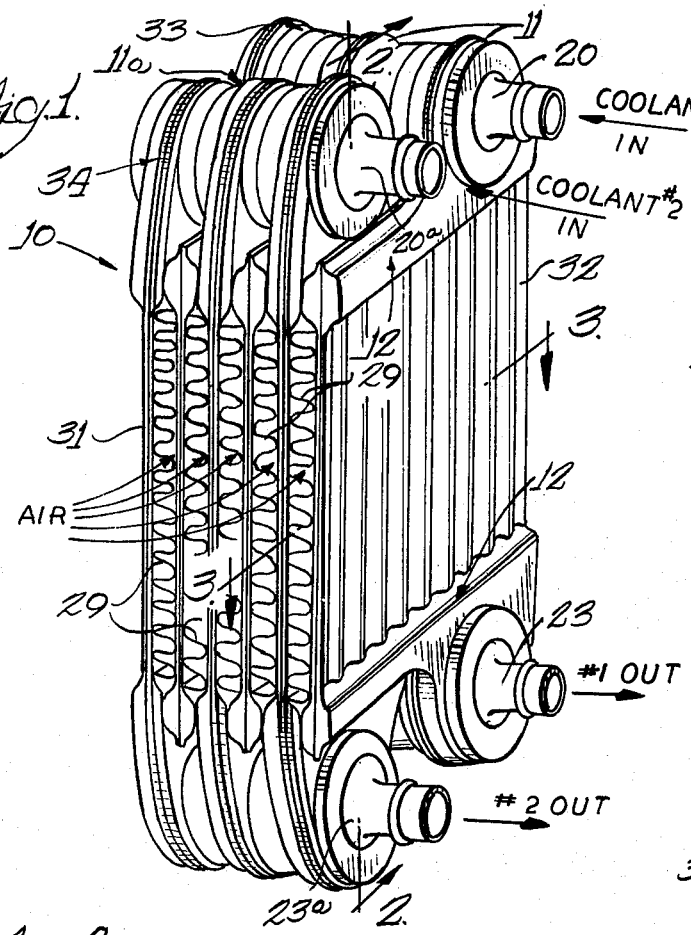
FIG. 1 is a perspective view of a first embodiment of the novel stacked plate assembly.
Figure 2:
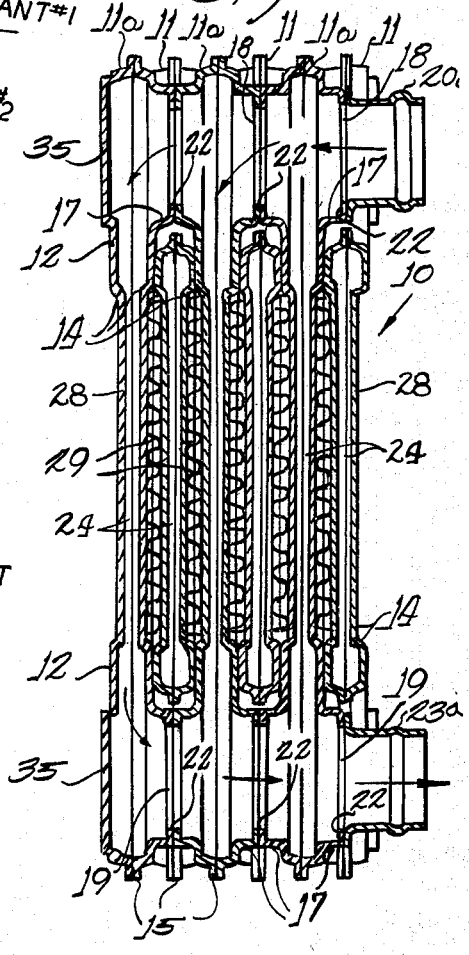
FIG. 2 is a vertical cross sectional view of the assembly taken on the line 2—2 of FIG. 1.

Referring more particularly to the disclosure in the drawings wherein are shown illustrative embodiments of the present invention, FIGS. 1 through 4 disclose a stacked plate heat exchanger 10 formed of a plurality of identical plate sections 11, 11*a*, each of which is formed of a heat conducting metal, such as copper or aluminum. Each section has upper and lower end chamber housings or headers 12, 12 connected by a heat transfer core portion 13 which has a suitable fluid dispersing configuration.

Each plate section 11 or 11a is formed from a pair of oppositely disposed dished blanks 14, 14 of mirrored symmetry which are joined along their peripheral edges 15 to form a hollow fluid conduit. Each end housing or header 12 is substantially L-shaped and comprises an elongated hollow tubular horizontal header or leg portion 16 running the full width of the section 11 or 11*a* and terminates at one end in an enlarged tubular conduit structure 17 forming the other leg of the L. Each conduit is of annular shape and provides an inlet port 18 or an outlet port 19 depending upon its disposition.

Figure 4:
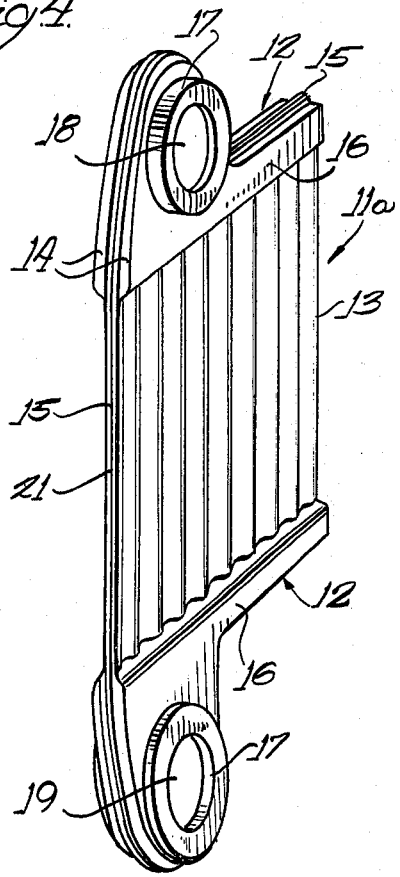
FIG. 4 is a perspective view of one of the plate sections forming the assembly.
Figure 3:
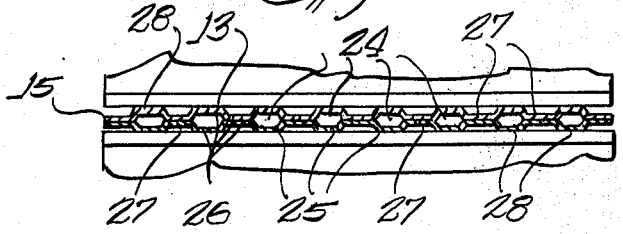
FIG. 3 is a horizontal cross sectional view of one of the plate sections taken on the line 3—3 of FIG. 1.

As more clearly seen in FIG. 4, the inlet and outlet conduits 17 of each plate section 11 or 11*a* are preferably disposed along a common edge 21 of the plate section and terminate in radially inwardly extending flanges 22, and the conduits of alternating plates are interconnected by any suitable means, such as soldering, brazing or welding at the flanges 22 to provide a continuous passage for fluid between the interconnected sections. The fluid enters the inlet ports 18 of the plate sections 11 or 11*a* through an inlet fitting 20 or 20*a* and flows into the headers 12 which are connected along their lengths to passages 24 defined by a plurality of tubes 25, which are formed by the opposing corrugations 26 of the core portions 13 of the respective plate sections (see FIG. 3); the other ends of the tubes being connected to the opposite headers 12 along their lengths and the fluid is exhausted from such opposite headers to the outlet ports 19 and the outlet fitting 23 or 23*a*.

The corrugations 26 not only provide the tubes but also are connected together at 27 to provide extensive heat radiating and conducting areas with the crest areas of the corrugations being flattened at 28 to provide extensive areas of contact with metal fins 29, which are preferably connected to the cores at the areas of contact by any of the above mentioned methods of connection. The fins 29 may be made from a single corrugated metal sheet, and the corrugations preferably run at right angles to the core corrugations so as to provide straight through air passages from one vertical edge 31 of the assembly to the opposite edge 32.

As clearly seen in FIG. 1, the heat exchanger 10 has a first plate assembly generally designated 33 and a second plate assembly generally designated 34. The plate sections of each assembly are substantially identical except that the plate sections of one assembly are reversed with respect to and alternately arranged with the plates of the second assembly, and the intervening spaces between the plate sections contain the metal fins 29. Considering FIG. 2, all of the plates in each assembly are identical except for the last plate, wherein the conduit structure 17 has a closed end 35 at the rear end of the assembly, so that fluid will only circulate through the plates of the particular set.

The novel design of the plate sections permits the inlet and outlet of each set of plates to be disposed along a common edge of the heat exchanger, thus facilitating connections to the fluid lines of the respective fluids with a minimum chance of crossing lines. Further, the structure is simplified so that both heat exchanger portions are provided from common parts. In addition, each core 13 provides primary heat exchange surfaces and the fins 29 provide secondary surfaces, so that the fins not only serve to transfer heat from one set of plates to the other, but also are in heat exchange relation to the fluid passing between the fins. Also, heat exchange is effected from the fluid in one set of plates 11 to the fluid in the other set of plates 11*a* which may serve as a heat sink.

In operation, the plates 11 are all connected together through their tubular conduits 17, and the plate sections 11a are interleaved with the plate sections 11 and are also interconnected through their tubular conduits 17; such that the plate sections of each assembly 33 or 34 are in fluid communication with each other. The inlet fitting 20 of the first plate assembly 33 receives a first fluid which passes through the tubular conduits 17 and into the horizontal headers 16. From the headers 16, the fluid enters the passages 24 in the core portions of the plates and passes therethrough to the opposite headers 16 and thence to the tubular conduits and the outlet fitting 23. Likewise, a second fluid enters the second plate assembly 34 through its inlet fitting 20*a* and passes through the tubular conduits 17, the horizontal headers 16, the passages 24 in the core portions of the plates, the lower horizontal headers 16, the tubular conduits 17 and the respective outlet fitting 23*a*. A third fluid, such as air, passes through the metal fins 29 which are interposed between the interleaved plate sections 11, 11*a*; the air passing through the passages from the one vertical edge 31 of the heat exchanger 10 to the other edge 32.

This compact single heat exchanger unit is preferably utilized in an automobile air conditioning system and performs the functions of both the heater and the evaporator coil. Thus, the first fluid would be a coolant, the second fluid would be a refrigerant, and the third fluid would be air. Depending on the season, either the first fluid or the second fluid could be selectively passed through the heat exchanger so that the air passing through the metal fins 29 would be either heated or cooled and then directed to the passenger compartment of the automobile. Also, the coolant solution in the heater section of the heat exchanger would serve as a heat sink for some of the refrigerating work of the air conditioning system, thus reducing the number of cycles required of the refrigerating system when working at less than a full load.

FIGS. 5 through 8 disclose an alternate embodiment of a stacked plate heat exchanger 36 comprising a plurality of identical plate sections 37, 37*a*, each of which is formed of suitable heat conducting metal. Each section has upper and lower end chamber housings or headers 38, 38 connected by a dimpled heat transfer core portion 39. The core portion is provided with indentations or dimples 41 formed in the flat outer surface 42 thereof; which dimples provide a non-uniform or turbulent flow pattern throughout the core portion for the fluid passing therethrough.

Each plate section 37 or 37*a* is formed from a pair of oppositely dished blanks 43, 43 of mirrored symmetry which are joined along their pheripheral edges 44 to form a hollow fluid conduit. Each end housing or header 38 provides an enlarged channel portion communicating with a fluid inlet 45 or outlet port 46 along one side 47 of the plate section. The enlarged header runs the full width of the section 37 having the port 45 or 46 at one corner and a recessed portion 48 having a through-port 49 therein at the opposite end of the channel. The recessed portions of the two dished blanks contact one another and are sealed at the port periphery 51 to prevent entrance or exit of fluid from the channel thereinto.

Figure 6:
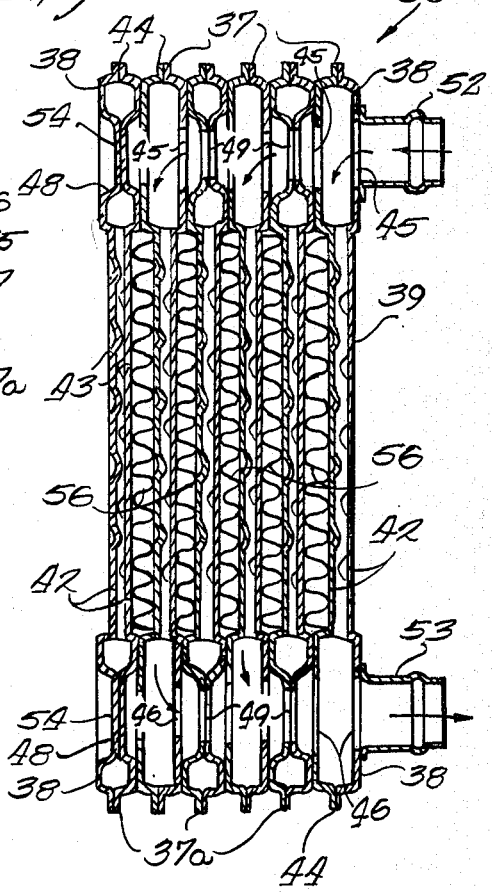
Fig. 6 is a vertical cross sectional view taken on line 6—6 of FIG. 5.
Figure 7:
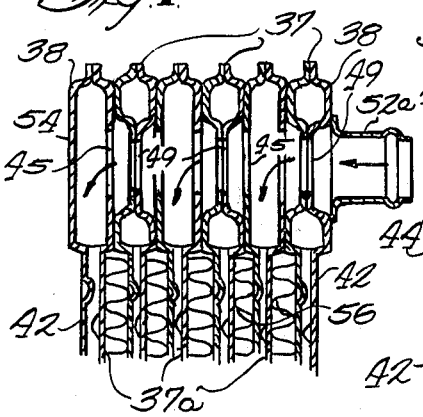
FIG. 7 is a vertical cross sectional view taken on line 7—7 of FIG. 5.
Figure 8:
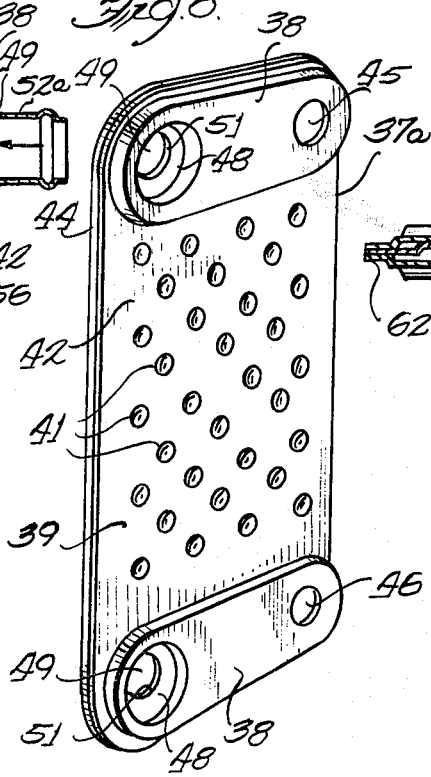
FIG. 8 is a perspective view of a single plate section of the stack of FIG. 5 with the alternate embodiment of fluid dispersion means for the plate.

As more clearly shown in FIG. 6, the headers 38 of the interleaved plate sections 37 and 37*a* are secured together along their abutting surfaces in fluid tight relation to provide fluid communication between the plate sections 37 and separate communication between the plate sections 37*a*. The inlet and outlet ports 45, 46 of the first plate section are adapted to be connected to fluid conduits (not shown) through the inlet fitting 52 and the outlet fitting 53. The last plate 37*a* is not pierced for the through-port to provide a closed wall 54. Thus, a first fluid will enter the inlet fitting 52 and flows through the ports 45 of the plate sections 37 to provide a continuous passage of fluid between the interconnected sections. The fluid flows from the inlet ports 45 into the headers 38 which are connected along their lengths to the core portions 39 formed of the parallel flat surfaces 42, with the dimples 41 interrupting and turbulizing the fluid flow through the core portions. Flow from the core portions exits through the oppositely disposed headers 38, the fluid outlet ports 46, and the outlet fitting 53.

Figure 5:
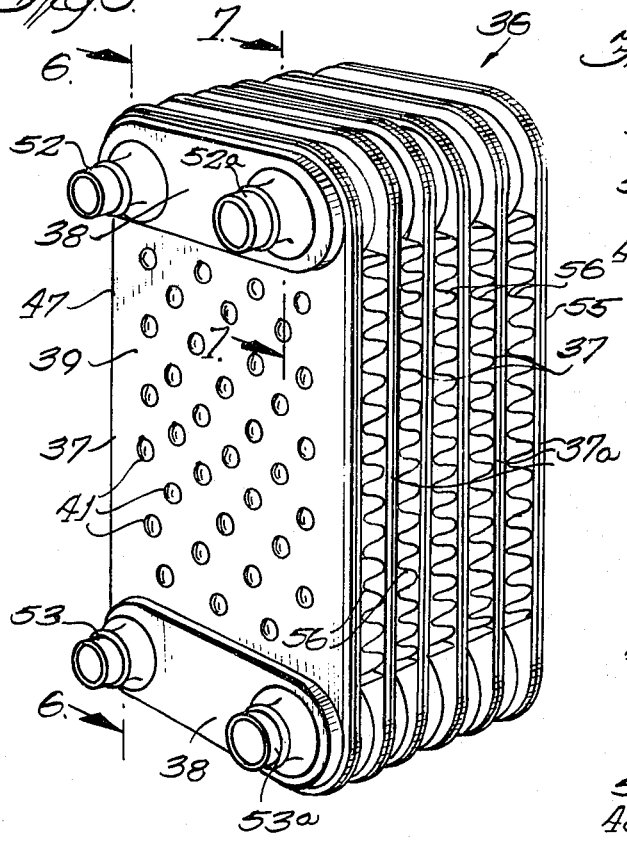
FIG. 5 is a perspective view of an alternate embodiment of heat exchanger of the present invention.

The plate sections 37*a* are interleaved with the plate sections 37, as shown in FIG. 5, and are oriented with their fluid inlet ports 45 and fluid outlet ports 46 along the opposite vertical edge 55 of the plate assembly. These plate sections 37*a* are also provided with an inlet fitting 52*a* and an outlet fitting 53*a* which communicates with the through-ports 49 of first plate 37 to the ports 45, 46 of the plates 37*a*. The enlarged headers 38 of the interleaved plate sections 37, 37*a*, sealingly abutting one another also provide spacing between the core portions 39 of the sections for metal fins 56 which are preferably corrugated and connected to the core portions 39 at the areas of contact by any suitable method. The fins 56 may be made from a single corrugated metal sheet and the corrugations again preferably run at right angles to the direction of fluid flow through the core portions to provide straight-through air passages from the one edge 47 of the assembly to the opposite edge 55. The flat surfaces 42 provide extensive areas of contact with metal fins 56 to enhance the heat transfer therebetween.

As clearly seen in FIG. 5, this design permits use of a single form of plate with no right hand or left hand configurations being required. The plate sections of each interconnected set are identical except that the plate sections of one set are reversed with respect to and alternated with the plates of the second set, and the intervening spaces between the plate sections contain the metal fins 56. Thus, the fins again not only serve to transfer heat from one set of plates to the other, but also are in heat exchange relation to the fluid passing between the fins. The function of this assembly is substantially the same as that described for the first heat exchanger 10 shown in FIGS. 1 through 4.

Figure 9:
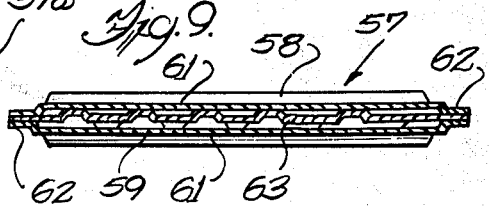
FIG. 9 is a horizontal cross sectional view through a plate section similar to FIG. 8 but showing a third embodiment of fluid dispersion means.

FIG. 9 discloses a third embodiment of plate section 57 including a pair of opposite headers 58 joined by a core portion 59. This plate section is also formed from a pair of oppositely dished blanks which are joined along their peripheral edges to form a hollow fluid conduit. The core portion is formed of a pair of parallel flat surfaces 61, 61 joined at their outer edges 62 to provide an elongated narrow fluid conduit. The fluid conduit houses a metal plate 63 of a suitable design to act as a fluid turbulizer within the core portion. Obviously, this turbulizer configuration could be used in either of the embodiments shown in FIGS. 1 through 4 or FIGS. 5 through 8 as a substitute for the corrugated or dimpled core portions. Also, the dimpled configuration shown in FIGS. 5 through 8 could be utilized in the first embodiment instead of the corrugated core.

Thus, the present invention discloses several effective, simple heat exchangers of efficient design. It will be noted that the plate sections shown in the drawings are each bilaterally symmetrical about a transverse axis such as line 3—3 of FIG. 1, and thus either end may be the top or bottom. Also, only the first and last plate sections in any of the assemblies require any modification beyond that shown for all of the other sections. Although the opposite headers shown in the drawings are substantially identical at each end of a plate, the headers for a plate do not need to be identical and can be of different configurations. Also, although the inlet and outlet ports for a plate are shown located along one edge of the plate, the inlet and ports could be positioned at diagonally opposite upper and lower corners of the plate as contemplated by the present invention.

I claim:

1. A multiple fluid heat exchanger comprising a first set of self-contained plates and a second set of self-contained plates of substantially identical construction, the second set of plates being reversely arranged and interleaved with the first set of plates, each plate formed of a pair of oppositely disposed metal sheets of dished configuration joined along their peripheries to provide an upper and a lower fluid header and a core portion interconnecting said headers, said fluid headers of said interleaved plates being positioned in abutting sealed relation, said first set of plates having inlet and outlet ports in registry and interconnected to provide fluid communication therethrough and said second set of plates having inlet and outlet ports in registry and interconnected to provide separate fluid communication therethrough, each fluid header comprising an enlarged fluid conduit portion extending the full width of the plate and having a port positioned adjacent one end of the header and a recessed portion providing a through-port adjacent the opposite end of the header.

2. A heat exchanger as set forth in claim 1, in which the inlet ports and outlet ports of said first set of plates are located along one side of the heat exchanger and the inlet ports and outlet ports of said second set of plates are located along the opposite side of the heat exchanger, said first and second sets of plates conducting first and second fluids therethrough.

3. A heat exchanger as set forth in claim 1, in which said core portions are of a lesser thickness than said headers, said interleaved core portions being spaced from each other in said integral assembly.

4. A heat exchanger as set forth in claim 1, in which said fluid headers of said interleaved plates are positioned in abutting sealed relation to provide independent communication between said sets of plates.

5. A heat exchanger as set forth in claim 4, in which a port in the header of a first plate is aligned and communicates with the through-port in the header of the next adjacent second plate and with a port in the header of a following third plate, such that fluid flow enters the first plate and the third plate through their respective ports but by-passes the interleaved second plate via the through-port.

6. A heat exchanger as set forth in claim 1, in which said core portion includes means to break up and disperse the flow of fluid therethrough.

7. A heat exchanger as set forth in claim 6, in which said dispersion means is formed by opposing corrugated segments of the plates to provide a plurality of fluid passages through said core portion.

8. A heat exchanger as set forth in claim 6, in which said core portion is formed by a pair of parallel metal sheets, and said dispersion means includes a plurality of indentations formed in said metal sheets to interrupt the flow of fluid through said core portion.

9. A heat exchanger as set forth in claim 6, in which said core portion is formed by a pair of parallel metal sheets forming a narrow tubular conduit, and said dispersion means includes a metal turbulizer positioned within said core portion.

* * * * *